US008366223B2

(12) United States Patent
Nagai

(10) Patent No.: US 8,366,223 B2
(45) Date of Patent: Feb. 5, 2013

(54) APPARATUS FOR COMMUNICATING WITH RFID TAG

(75) Inventor: Takuya Nagai, Nagoya (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 131 days.

(21) Appl. No.: 12/883,240

(22) Filed: Sep. 16, 2010

(65) Prior Publication Data

US 2011/0001769 A1 Jan. 6, 2011

Related U.S. Application Data

(63) Continuation-in-part of application No. PCT/JP2009/052920, filed on Feb. 19, 2009.

(30) Foreign Application Priority Data

Mar. 26, 2008 (JP) ..... 2008-079843

(51) Int. Cl.
*B41J 3/00* (2006.01)
*B41J 29/38* (2006.01)

(52) U.S. Cl. ..... 347/2; 347/5

(58) Field of Classification Search ..... None
See application file for complete search history.

(56) References Cited

U.S. PATENT DOCUMENTS

| | | | | |
|---|---|---|---|---|
| 6,100,804 | A * | 8/2000 | Brady et al. | 340/572.7 |
| 6,863,756 | B2 * | 3/2005 | Nedblake et al. | 156/64 |
| 2005/0100689 | A1 | 5/2005 | He et al. | |
| 2007/0009732 | A1 | 1/2007 | Tsai et al. | |
| 2007/0275319 | A1 | 11/2007 | He et al. | |

FOREIGN PATENT DOCUMENTS

| | | |
|---|---|---|
| JP | 2003140548 | 5/2003 |
| JP | 2004082432 | 3/2004 |
| JP | 2005149427 | 6/2005 |
| JP | 2005349700 | 12/2005 |
| JP | 2007276486 | 10/2007 |

* cited by examiner

*Primary Examiner* — Geoffrey Mruk
(74) *Attorney, Agent, or Firm* — McCarter & English, LLP

(57) ABSTRACT

An apparatus for communicating with an RFID tag having a feeding device that feeds a tag tape including an RFID tag circuit element having an IC circuit part and a tag antenna. The RFID circuit element is disposed on one side area along a width direction. To produce an RFID label a fixed inkjet head applies color printing to the one side area and a thermal head prints on another side area along the width direction. An apparatus antenna transmits and receives information to/from the RFID tag circuit element.

6 Claims, 10 Drawing Sheets

APPARATUS FOR COMMUNICATING WITH RFID TAG

CROSS-REFERENCE TO RELATED APPLICATION

This is a CIP application PCT/JP2009/52920, filed Feb. 19, 2009, which was not published under PCT article 21(2) in English.

BACKGROUND OF THE INVETNTION

1. Field of the invention

The present invention relates to an apparatus for communicating with a radio frequency identification (RFID) tag that produces an RFID label provided with an RFID tag circuit element capable of radio communication of information with the outside.

2. Description of the Related Art

A Radio Frequency Identification (RFID) system that reads and writes information in a non-contact manner between a small-sized RFID tag and a reader/writer, which is a reading device and a writing device, is known in a prior art reference.

An apparatus for communicating with an RFID tag that produces an RFID label provided with an RFID tag circuit element used in such an RFID system has been already proposed. With the apparatus of the prior art reference, a label provided with an RF-ID element, which is an RFID tag circuit element, is attached to a label sheet that constitutes a tape. The label attached to the label sheet is constructed as a roll-shaped recording medium. Then, while the tape is being fed out of this roll and transported, printing is applied on a surface of the label by a thermal head as a recording head. After this printing, information is transmitted from a communication antenna on the apparatus side to the RFID tag circuit element in the transport state and desired information writing is performed. As a result, RFID labels with print are continuously produced.

Recently, with progress of an RFID tag technology, the RFID labels with print have been widely spread and begun to be used. In this trend, there is a need that a color identifier already widely used in an application of document management, for example, that is, an RFID label with print with a color identifier is to be produced by printing a so-called color code, for example.

However, with the prior art reference, printing of the color identifier is not considered. As a result, it has been difficult to efficiently produce an RFID label with a color identifier. In order to produce such an RFID label with print with a color identifier, an inkjet head can be used other than the thermal head. In this case, there should be an area on which printing is applied by the thermal head and an area on which printing of a color identifier is applied by the inkjet heat in a tape. However, if the RFID tag circuit element is arranged on the area for printing by the thermal head, it is likely that damage is caused by heating. Thus, consideration is separately needed to avoid the heating damage between arrangement positions of the thermal head and the inkjet head and an arrangement position of the RFID tag circuit element in the tape.

SUMMARY OF THE INVENTION

The present invention has an object to provide an apparatus for communicating with an RFID tag that can efficiently produce an RFID label with print with a color identifier while damage on the RFID tag circuit element is prevented.

Means for Solving the Problem

There is provided a apparatus for communicating with a radio frequency identification (RFID) tag, comprising: a feeding device that feeds a tag tape including an RFID tag circuit element having an IC circuit part storing information and a tag antenna that performs information transmission and reception, the RFID circuit element disposed on one side area along a width direction of the tag tape; an inkjet head disposed fixedly so as not to be moved during an operation so that color printing is applied to the one side area of the tag tape that is fed by the feeding device; a thermal head disposed capable of printing on the other side area of the tag tape along the width direction other than the one side area of the tag tape that is fed by the feeding device; and an apparatus antenna that performs information transmission and reception via radio communication with the RFID tag circuit element, wherein printing by the inkjet head and the thermal head is performed so as to produce an RFID label.

DETAILED DESCRIPTION OF THE PREFERRED EMBODIMENTS

Figure 1:
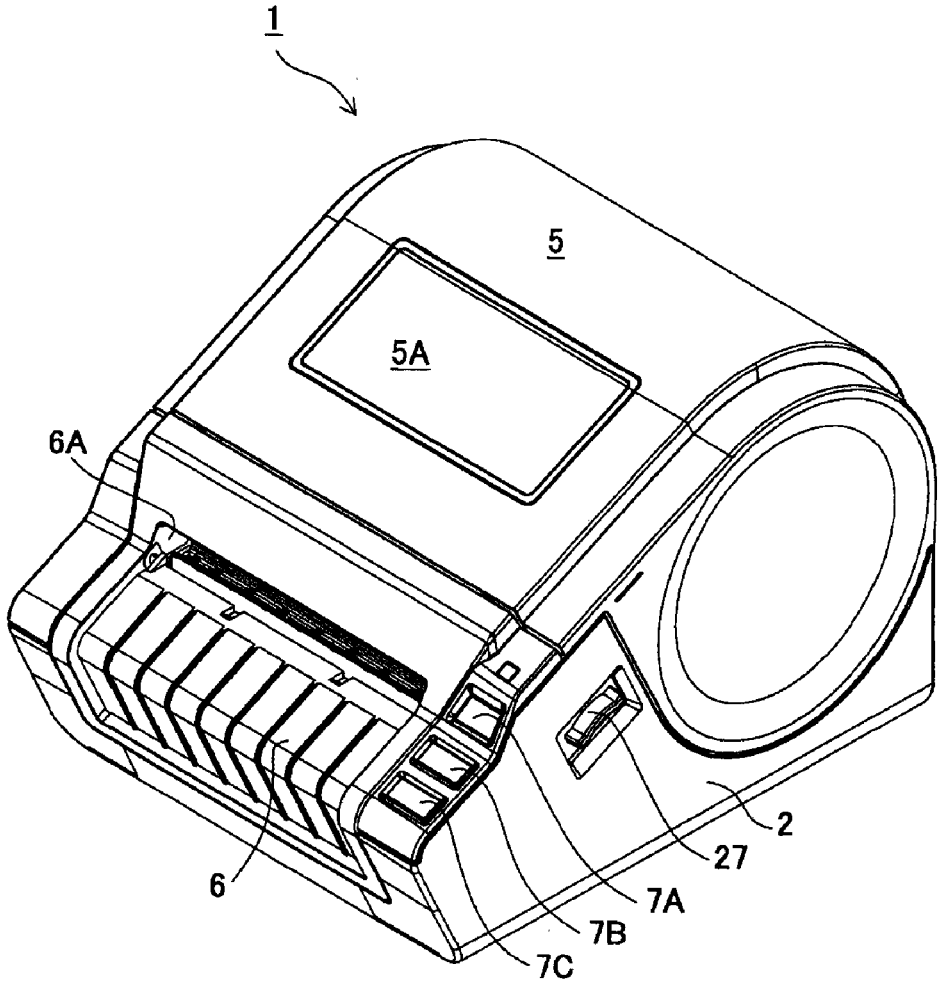
FIG. 1 is a perspective view illustrating an appearance of an apparatus for communicating with an RFID tag of an embodiment of the present invention seen from the front above.

As shown in FIG. 1, an apparatus 1 for communicating with an RFID tag of this embodiment has a housing 2 provided with a front panel 6 made of a resin and an upper cover 5 made of a resin.

On both right and left side walls of the housing 2, a release knob 27 is disposed. The release knob 27 unlocks the upper cover 5 from the housing 2 by being pushed upward so that the upper cover 5 is brought into an openable state. Also, on one of the right and left side walls of the housing 2, that is, at an upper face position close to a front on the right side wall in this example, a power source button 7A, a feed button 7B, a cut button 7C, and an LED lamp, not shown, for example, of the apparatus 1 are disposed. When the feed button 7B is operated, the distal end of a tag tape 3A (See FIG. 2, which will be described later) is led out. When the cut button 7C is operated, cutting of the tag tape 3A by a cutter unit 8 (See FIG. 3, which will be described later) is performed.

At a position close to the rear of the front panel 6, an outlet 6A is disposed. The outlet 6A leads out the tag tape 3A contained in an internal space of the housing 2 to the outside of the housing 2.

In the upper cover 5, a transparent window 5A made of a transparent resin through which the tag tape 3A contained in the internal space of the housing 2 can be checked is formed.

Figure 2:
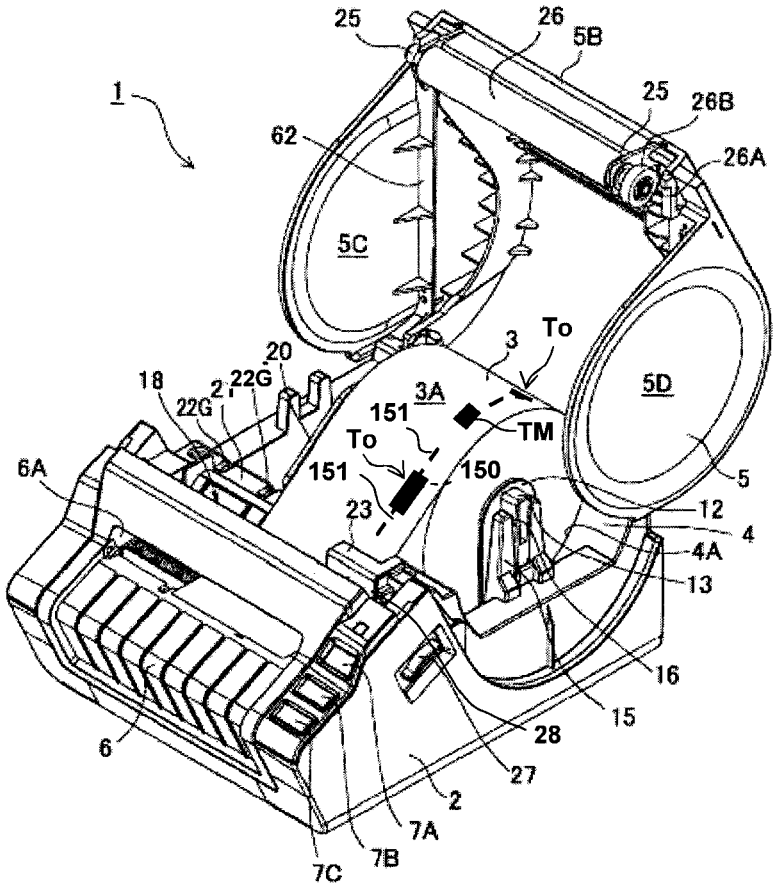
FIG. 2 is a perspective view of the apparatus for communicating with an RFID tag in FIG. 1 illustrating a state with an upper cover opened from the right above.

As shown in FIG. 2, in the internal space of the housing 2, substantially in a rear part in a longitudinal direction, a recess-shaped tape holder container portion 4 is disposed. In the tape holder container portion 4, a tape holder 3 is contained and arranged.

The tape holder 3 includes a positioning holding portion 12 and a guide member 20. In the tape holder 3, the tag tape 3A of a predetermined width is wound in a roll shape capable of rotation, and a tag tape roll includes this wound tag tape 3A. On the both sides in an axial direction of the tag tape 3A, the guide member 20 and the positioning holding member 12 are disposed. Also, the upper cover 5 is disposed so as to cover the upper side and the both right and left sides of the tape holder container portion 4. The upper cover 5 is attached to a rear-side upper-end edge portion of the main body housing 2 capable of being opened and closed.

On one of side-end edge portions substantially in a perpendicular direction with respect to a tape feeding direction in the tape holder container portion 4, a holder supporting member 15 is disposed. In this holder supporting member 15, a first positioning groove portion 16 opened upward is formed. When a vertically long attachment member 13 is brought into close contact with the first positioning groove portion 16, it is fitted in the holder supporting member 15.

On a bottom face portion of the tape holder container portion 4, a positioning recess portion 4A (See also FIG. 3, which will be described later) in a laterally long square of a predetermined depth on a plan view is disposed. Also, at an inner base end portion of the holder supporting member 15 of the positioning recess portion 4A, a recess portion 4B for tape distinction (See FIG. 4) is formed. The recess portion 4B is formed at a position opposite a tape distinction portion 60 (See FIG. 4, which will be described later). The recess portion 4B is provided with a plurality of tape distinction sensors P1 to P6 (See FIG. 4) including a push-type micro switch, for example. The recess portion 4B is constructed capable of detecting the type of the tag tape 3A by the tape distinction portion 60.

Also, on the front portion in the tape feeding direction of the positioning recess portion 4A, a loading portion 21 on which a distal end portion of the guide member 20 is loaded is disposed. On the rear side in the feeding direction of the loading portion 21, a second positioning portion 22G is formed. The second positioning portion 22G with a substantially L-shaped section is disposed in seven corresponding to a plurality of width dimensions of the tag tape 3A. The attachment member 13 of the positioning member 12 is fitted in the first positioning groove portion 16 of the holder supporting member 15. A distal end portion lower end of the guide member 20 is fitted in any one of the second positioning groove portions 22G Then, the lower end portion of the guide member 20 enters the positioning recess portion 4A and is brought into contact therewith. As a result, the tape holder 3 around which the tag tape 3A is wound in the roll shape is detachably attached in a state positioned to the tape holder container portion 4. With this arrangement, since the rolled tag tape 3A is detachable through the tape holder 3, the tag tape 3A medium, which is consumable goods, can be replaced easily. Also, a tape insertion port 18 is disposed on the front portion in the tape feeding direction of the guide member 20. The tag tape 3A is held by being inserted into the tape insertion port 18 and led out of the outlet 6A. On the holder supporting member side of the tape insertion port 18, a sensor 23 that detects a tape head position is disposed. When the sensor 23 detects a tape head position mark TM disposed on the tag tape 3A, the head position of the label, which is a printing start position, can be recognized.

At this time, the upper cover 5 includes an upper cover main body 5B and substantially circular right and left side cover members 5C and 5D. The upper cover main body 5B is pivotally attached to a rear-side upper-end edge portion of the housing 2 and is constructed capable of being opened and closed. The right and left side cover members 5C and 5D are fastened to right and left of the upper cover main body 5B by screwing, for example. On inner side faces of the right and left cover members 5C and 5D, a plate-shaped reinforcement rib 62 is disposed upright. The reinforcement rib 62 is arranged at the same position in the circumferential direction in the cover members 5C and 5D over the diameters of the cover members 5C and 5D. Then, when the upper cover 5 is closed, the reinforcement rib 62 of the right cover member 5D is brought into contact with the upper end face of the attachment member 13 of the tape holder 3 so as to hold the tape holder 3 in a positioned state. At a position where the reinforcement rib 62 is in contact with the upper end face of the attachment member 13, a thin plate-shaped holder pressing portion 65 (See FIG. 4) of a predetermined width is extended.

On the other hand, in the internal space of the housing 2, on the lower side of the front end portion of the upper cover main body 5B, a platen roller 26 that drives the tag tape 3A is rotatably supported. To both end portions of a roller shaft 26A of the platen roller 26, a collar member 25 is rotatably attached. The roller shaft 26A constitutes a feeding device described in each claim. At one of shaft ends of the roller shaft 26A, a gear 26B that drives the platen roller 26 is fixed. As a result, when the upper cover 5 is closed, the collar member 25 is engaged with a locking claw 28 positioned substantially on both sides of the tape insertion port 18 in the front of the loading portion 21 against an urging force. As a result, the upper cover 5 is locked in the closed state. Along with that, the platen roller 26 is brought into contact with a line-type thermal head 31 (See FIG. 3) as a print head through the tag tape 3A, which realizes a printable state. Also, the gear 26B of the platen roller 26 is meshed with a gear train, not shown, on the apparatus main body side. A motor 208 for platen roller (See FIG. 9) including a stepping motor, for example, rotates and drives the platen roller 26, whereby feeding of the tag tape 3A is made possible. On the side-end edge portion on the holder supporting member 15 side of the tape insertion port 18, a guide rib portion (not shown) with a substantially L-shape on a plan view is disposed. The guide rib portion has a lower face as a guide face by having the lower side cut away.

Figure 3:
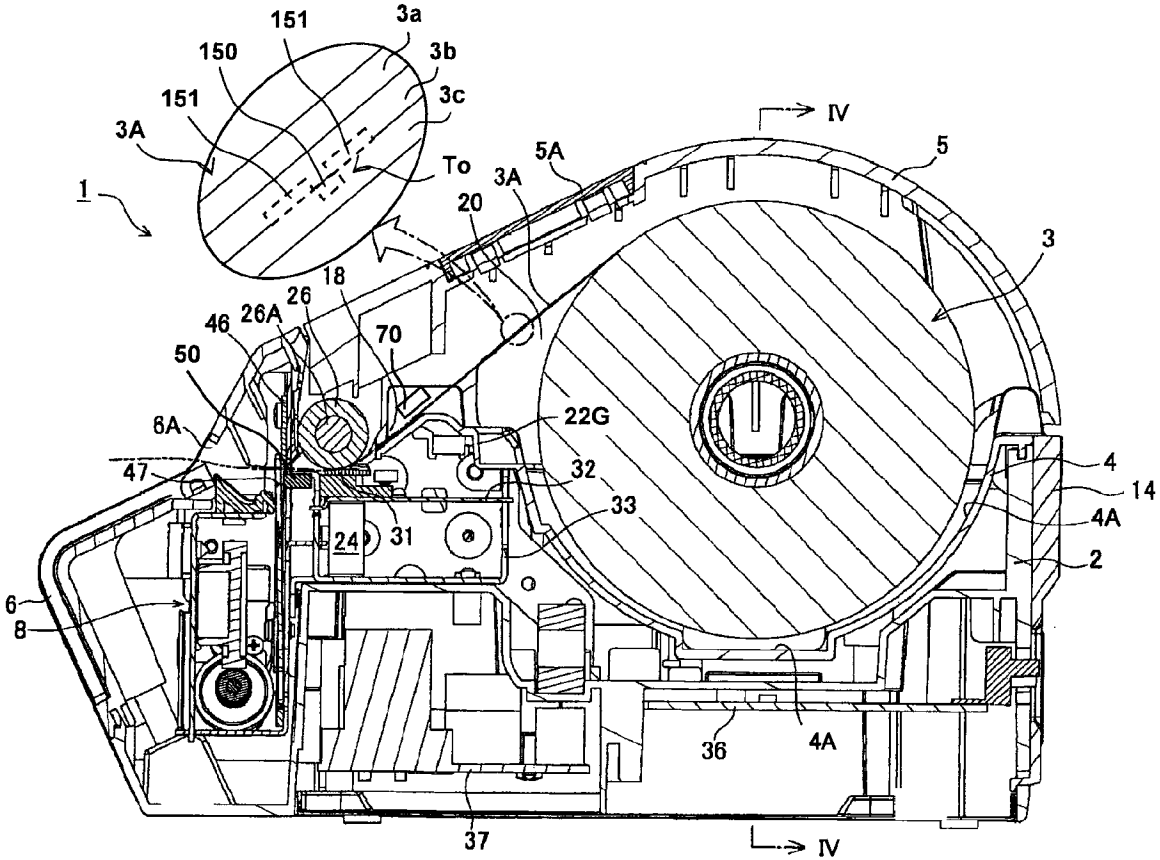
FIG. 3 is a partially broken perspective view of the apparatus for communicating with an RFID tag in FIG. 1 illustrating a state with the upper cover opened from the left above.
Figure 4:
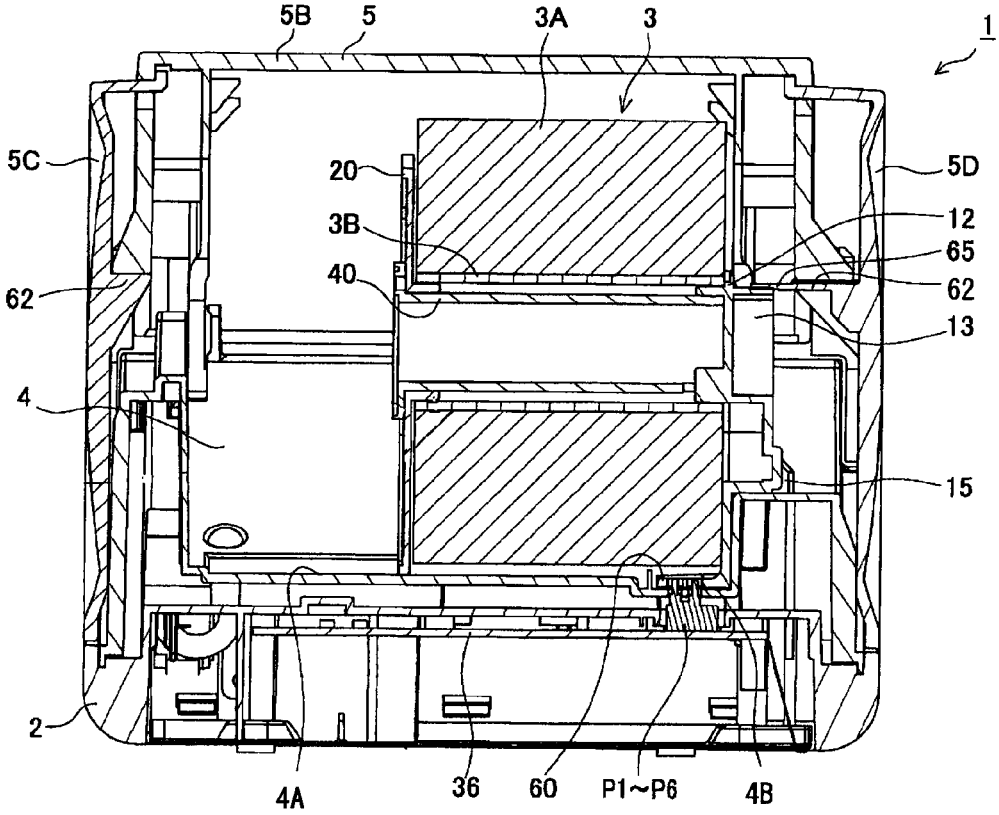
FIG. 4 is a sectional view by a IV-IV section in FIG. 3.

As shown in FIGS. 3 and 4, the tag tape 3A is wound around a winding core 3B in a roll shape. A substantially cylindrical holder shaft member 40 is disposed between the positioning holding member 12 and the guide member 20. The holder shaft ember 40 is arranged in the axial direction on the inner circumference side of the winding core 3B. Mainly the positioning holding member 12, the guide member 20, and the holder shaft member 40 constitute the tape holder 3. Also, on the lower side of the tape holder container portion 4, a control substrate 36 is disposed in which a control circuit portion that drives and controls each mechanism portion on the basis of an instruction from an external personal computer, for example, is formed.

On the tag tape 3A, an RFID tag circuit element To is arranged. The RFID tag circuit element To is provided with an IC circuit part 150 and a tag antenna 151. The RFID tag circuit elements To are aligned along the tape longitudinal direction on one side in the tape width direction, which is the right front side in FIG. 2 in this example. The tag tape 3A has, as shown in a partially enlarged view in FIG. 3, a three-layer structure in this example. The tag tape 3A has a separation sheet 3*a*, which is a separation agent layer, an adhesive layer 3*b*, which is an affixing adhesive layer, and a so-called thermal paper 3*c*, which is a lengthy thermal paper having self color-producing properties, laminated in order toward the lower right side in FIG. 3.

On a back side of the thermal paper 3*c*, that is, on the upper left side in FIG. 3, the IC circuit part 150 that stores information is disposed integrally in this embodiment. On a surface on the rear side of the thermal paper 3*c*, the tag antenna 151 connected to the IC circuit part 150 and performs information transmission and reception is formed. The RFID tag circuit element To includes the IC circuit part 150 and the tag antenna 151. On the rear side of the thermal paper 3*c*, that is, on the upper left side in FIG. 3, the separation sheet 3*a* is bonded to the thermal paper 3*c* by the adhesive layer 3*b*. This separation sheet 3*a* is used when the finally completed RFID label T is attached to desired goods, for example. By peeling off the separation sheet 3*a*, the tab label is bonded to the goods, for example, by the adhesive layer 3*b*. On the face of the separation sheet 3*a* opposite the adhesive layer 3*b*, the tape head position mark TM by which a printing start position is known through the sensor 23 is printed at a predetermined position.

In the internal space of the housing 2, above a feeding path of the tag tape 3A, an apparatus antenna 70 is disposed. In more detail, the apparatus antenna 70 is located on the upstream side in the tape feeding direction of the tape insertion port 18.

The apparatus antenna 70 accesses the IC circuit part 150 through the tag antenna 151 of the RFID tag circuit element To disposed on the tag tape 3A. In this example, the access refers to information reading or writing.

Also, in the internal space of the housing 2, below the feeding path of the tag tape 3A or in more detail, on the lower side of the insertion port 18, an inkjet head 50 and the thermal head 31 are disposed fixedly. The inkjet head 50 performs color printing to the tag tape 3A. The thermal head 31 performs monochrome printing to the tag tape 3A as described above. The inkjet head 50 and the thermal head 31 are arranged in the order of the thermal head 31 and the inkjet head 50 from the upstream side of the tape feeding direction.

The thermal head 31 is fixed to one end of the supporting member 32 urged upward by a spring member 24.

During printing, an operator inserts the tag tape 3A into the tape insertion port 18 while the operator brings one side of the tag tape 3A, that is, a side-end-edge portion on the left depth side in FIG. 2, into contact with the inner side face of the guide member 20 and brings the other side of the tag tape 3A, that is, the side-end edge portion on the right front side in FIG. 2, into contact with the guide rib portion. The tag tape 3A having been inserted through the insertion port 18 is pressed by the thermal head 31 toward the platen roller 26.

Moreover, in the internal space of the housing 2, on the downstream side in the tape feeding direction of the inkjet head 50, the cutter unit 8 is disposed. The cutter unit 8 is provided with a v-shaped movable blade 47 on a front view and a fixed blade 46. The movable blade 47 is arranged movably in a cutting direction substantially orthogonal to the longitudinal direction of the tag tape 3A, that is, in the upward direction in FIG. 3. The fixed blade 46 is arranged opposite the movable blade 47. Below a frame 33, a power source substrate 37 on which a power source circuit part is formed is disposed.

Figure 5A:
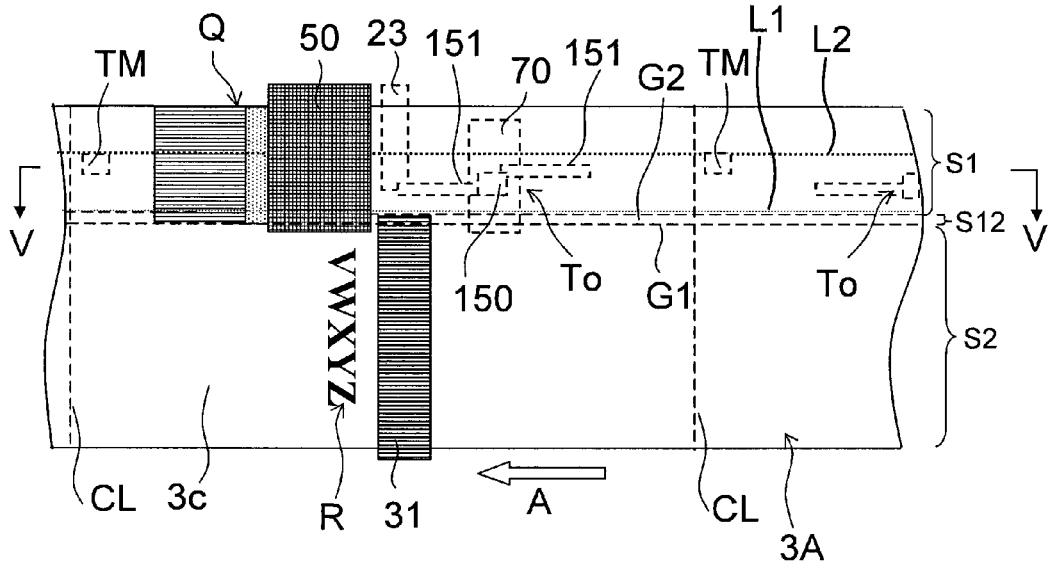
FIG. 5A is a bottom view seen from a thermal paper side of a tag tape illustrating a positional relationship between an apparatus antenna, a thermal head, and an inkjet head and the tag tape.
Figure 5B:
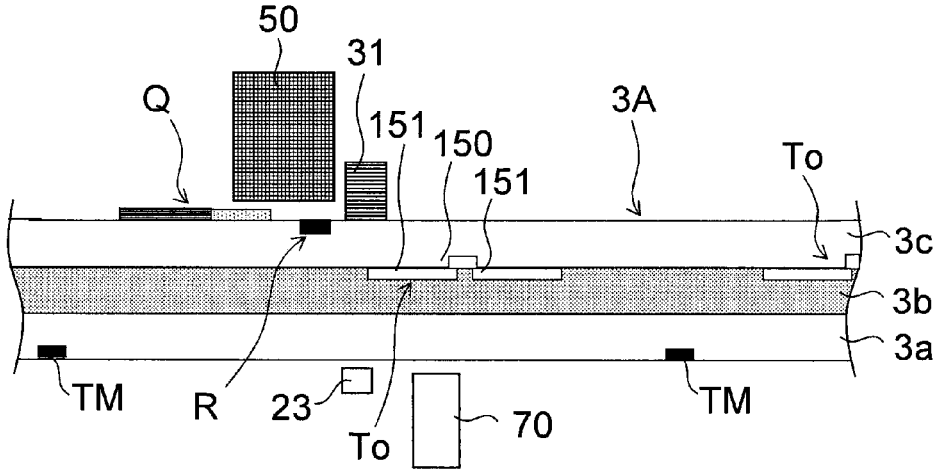
FIG. 5B is a sectional view by a V-V section in FIG. 5A.

As shown in FIGS. 5A and 5B, the tag tape 3A has the above-described three layer structure. That is, the tag tape 3A has the thermal paper 3*c*, the adhesive layer 3*b* and the separation sheet 3*a* laminated in this order from a surface side, that is, the upper side in FIG. 5B to the attachment side to an attachment target on the opposite side, that is, the lower side in FIG. 5B.

The thermal head 31 and the inkjet head 50 are installed on the thermal paper 3*c* side of the tag tape 3A or below the tag tape 3A in FIG. 3. The apparatus antenna 70 is installed on the separation sheet 3*a* side of the tag tape 3A or above the tag tape 3A in FIG. 3. As described above, the apparatus antenna 70, the thermal head 31, and the inkjet head 50 are arranged in order from the upstream side along the tape feeding direction indicated by an arrow A.

The tag tape 3A is conceptually divided into a area S1, a area S12, a area S2 in order from one side in the width direction to the other side in the width direction. The area S1 and the area S12 constitute a one-side area in the width direction described in each claim, while the area S2 constitutes the other-side area in the width direction described in each claim. The inkjet head 50 is capable of color printing on the area S1 and the area S12 in the thermal paper 3*c* in the tag tape 3A. As shown in FIGS. 5A and 5B, the inkjet head 50 is arranged so as to oppose the one-side end portion in the width direction of the tag tape 3A. In the area S1, as shown in FIG. 5A, the RFID tag circuit elements To are aligned along the tape longitudinal direction.

The thermal head 31 is capable of monochrome printing on the area S2 and the area S12 in the thermal paper 3*c* of the tag tape 3A. As a result, on the area S12, the color printing by the inkjet head 50 and the monochrome printing by the thermal head 31 can be both applied. In order to realize such printing, as shown in FIG. 5A, the arrangement position in the tape width direction of the thermal head 31 and the arrangement position in the tape width direction of the inkjet head 50 are partially overlapped. As a result, generation of a printing blank area in the width direction of the tag tape 3A can be reliably prevented. On the area S2, only the monochrome printing can be made by the thermal head 31.

On the other hand, in the tag tape 3A, folding lines L1 and L2 are set along the tape longitudinal direction. The folding lines L1 and L2 are used, as will be described later, when the tag tape is attached as an RFID label T. The folding lines L1 and L2 may be formed by printing on the thermal paper 3*c* or may be set only conceptually and does not have to be printed. The folding lines L1 and L2 are set at positions in the tag tape 3A where they are not overlapped in the tape thickness direction with the RFID tag circuit element To on a plan view. In this example, the folding lines L1 and L2 are set on both sides in the tape width direction, respectively, shown on the upper side and the lower side in FIG. 5A. Only either one of the folding lines L1 and L2 may be disposed. The folding lines L1 and L2 are both set in the area S1 and the folding line is not set on the area S2.

As shown in FIG. 5A, a cutting position CL where the tag tape 3A is cut off one by one at a predetermined length to form the RFID label T is set in the tag tape 3A between the RFID tag circuit elements To arranged in the longitudinal direction.

In the apparatus 1 with the above-described configuration, after the upper cover 5 is closed, the platen roller 26 is rotated and driven by the motor 208 for platen including a stepping motor, for example, (See FIG. 9, which will be described later). As a result, the tag tape 3A is fed while one of the side-end edge portions of the tag tape 3A withdrawn from the tape holder 3 is in contact with the inner side face of the guide member 20 and the other side-end edge portion of the tag tape 3A is in contact with the guide rib disposed on the side edge portion of the insertion port 18. The tag tape 3A that has been fed is led into the front panel 6 through the insertion port 18.

The tag tape 3A passes through the thermal head 31 and the inkjet head 50 after the tape head position mark TM passes through the front of the sensor 23. At the passage, by means of the thermal head 31 that is driven and controlled, desired monochrome printing R is applied on the area S2 or the area S12 of the thermal paper 3*c*. Moreover after the passage, by means of the inkjet head 50 that is driven and controlled, predetermined color printing Q is applied on the area Si or the area S12 of the thermal paper 3*c*. Also, when the RFID tag circuit element To disposed on the tag tape 3A has moved to the vicinity of the apparatus antenna 70 at a position in front on the upstream side in the tape feeding direction of the insertion port 18, an access is made to the RFID tag circuit element To by the apparatus antenna 70. The access in this case is information reading or information writing. After that, the tag tape 3A with print is led out onto the front panel 6 from the outlet 6A and extended by a predetermined length from the cutter unit 8. At this time, when the cutter button 7C is operated, the tag tape 3A is cut off by the cutter unit 8. As a result, the RFID label T (See FIG. 7, which will be described later) including the RFID tag circuit element To and provided with the color printing Q and the monochrome printing R is produced.

Figure 6:
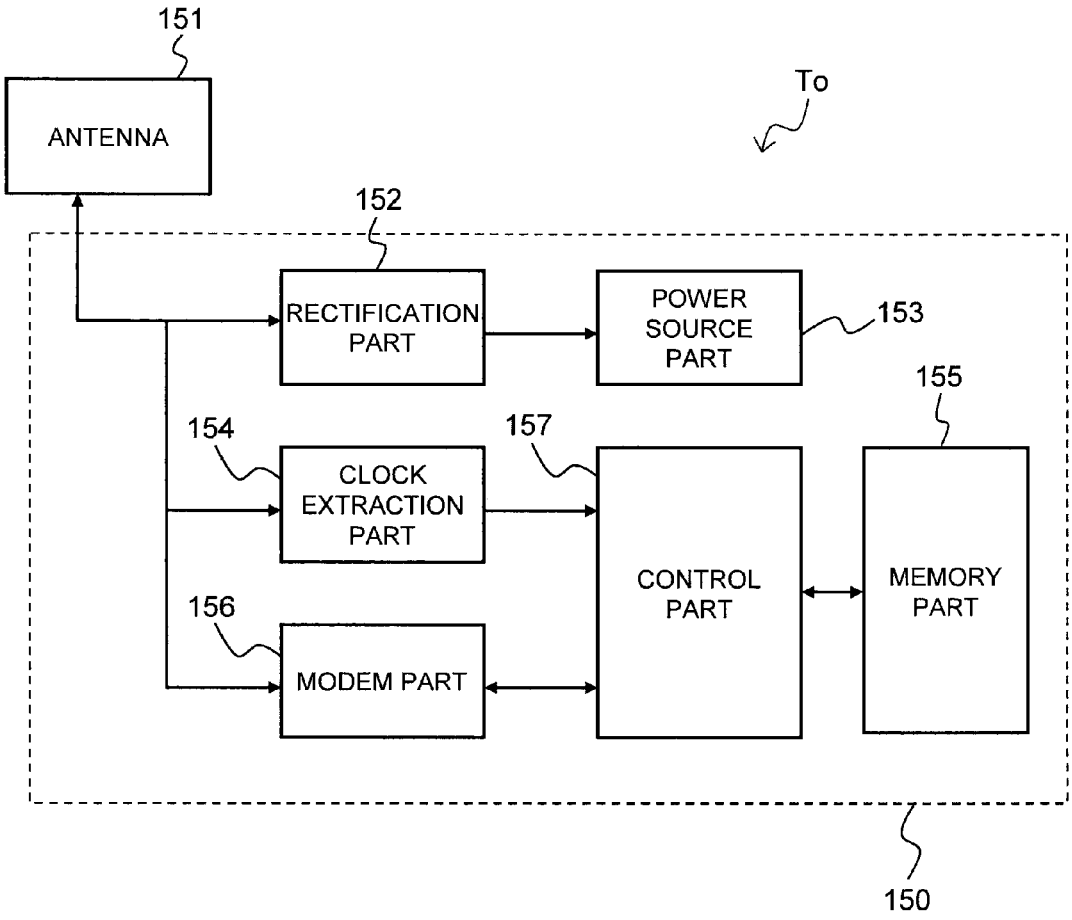
FIG. 6 is a functional block diagram illustrating a functional configuration of an RFID tag circuit element disposed on a tag tape.

The RFID tag circuit element To has, as shown in FIG. 6, the tag antenna 151 that performs transmission and reception of a signal in a non-contact manner with the apparatus antenna 70 of the apparatus 1 as described above and the IC circuit part 150 connected to this tag antenna 151. The tag antenna 151 is a dipole antenna in this example.

The IC circuit part 150 includes a rectification part 152, a power source part 153, a clock extraction part 154, a memory part 155, a modem part 156, and a control part 157. The rectification part 152 rectifies an interrogation wave received by the tag antenna 151. The power source part 153 accumulates energy of the interrogation wave rectified by the rectification part 152 and uses the energy as a driving power source. The memory part 155 is capable of storing predetermined information signals.

The modem part 156 is connected to the tag antenna 151 and demodulates a communication signal from the apparatus antenna 70 of the apparatus 1, received by the tag antenna 151. The modem part 156 also modulates a reply signal from the control part 157 and transmits a response wave, that is, a signal including a tag ID, from the tag antenna 151.

The clock extraction part 154 extracts a clock component from the interrogation wave received by the tag antenna 151 and extracts the clock to the control part 157. The clock extraction part 154 supplies the clock corresponding to a frequency of the clock component of the received signal to the control part 157.

The control part 157 controls operations of the RFID tag circuit element To through the memory part 155, the clock extraction part 154, and the modem part 156, for example. The control part 157 interprets a received signal demodulated by the modem part 156 and generates a reply signal on the basis of the information signal stored in the memory part 155. The generated reply signal is replied by the modem part 156 from the tag antenna 151.

Figure 7A:
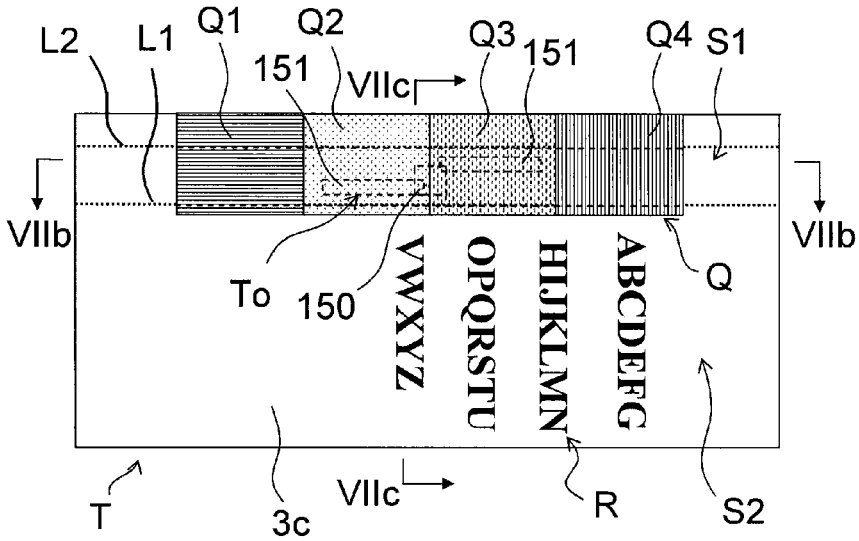
FIG. 7A is a plan view illustrating a configuration example of the RFID label.
Figure 7B:
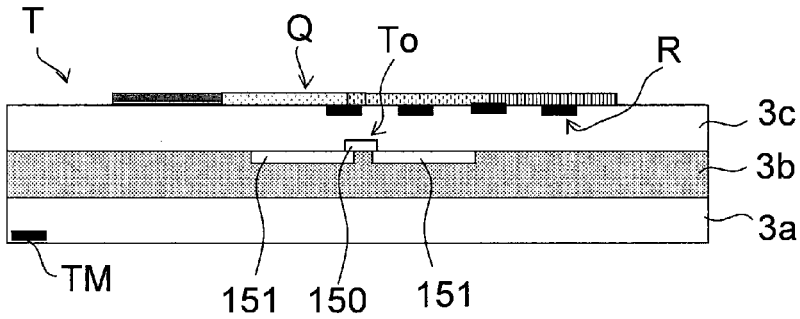
FIG. 7B is a sectional view by a VIIb-VIIb section in FIG. 7A.
Figure 7C:
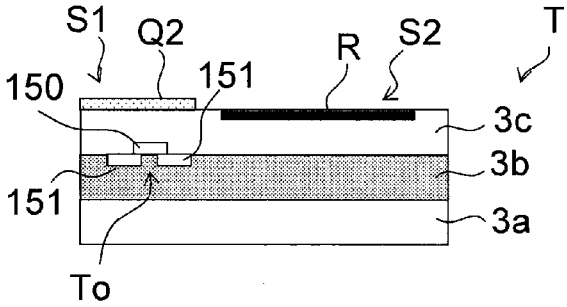
FIG. 7C is a sectional view by a VIIc-VIIc section in FIG. 7A.

In FIGS. 7A to 7C, the RFID label T has the three layer structure as described above. The RFID label T has the thermal paper 3*c*, the adhesive layer 3*b*, and the separation sheet 3*a* laminated in the order from the upper side in FIGS. 7B and 7C, which is a surface side toward a lower side in FIGS. 7B and 7C, which is the opposite side. As described above, on the rear side of the thermal paper 3*c*, the RFID tag circuit element To including the IC circuit part 150 and the tag antenna 151 is disposed. The RFID tag circuit element To may be arranged in the vertically opposite direction in FIGS. 7B and 7C.

Also, on the surface of the thermal paper 3*c* on the RFID label T, the color printing Q is applied within the area S1 by the inkjet head 50 and the monochrome printing R is applied within the area S2 by the thermal head 31.

As the color printing Q, plural colors used in document management, for example, or four colors in this example of color codes Q1, Q2, Q3, and Q4 as color identifiers are printed. An operator determines contents indicated by the color codes Q1, Q2, Q3, and Q4 as appropriate. For example, the color code Q1 is a code of a document-producing office that indicates the name or the type of the office that produced the document as an attachment target of the RFID label T. The color code Q2 is a document-producing year code that indicates the year when the document was produced. The color code Q3 is a document-producing month code that indicates the month when the document was produced. The color code Q4 is a document-producing staff code that indicates the name or an employee number, for example, of the staff who produced the document.

As the monochrome printing R, text characters and barcodes are printed in a monochrome. In this example, characters that indicate the document-producing office, "ABCDEFG", characters that indicate the document-producing year, "HIJKLMN", characters that indicate the document-producing month, "OPQRSTU", and characters that indicate the document-producing staff, "VWXYZ" are printed using the black color.

Figure 8:
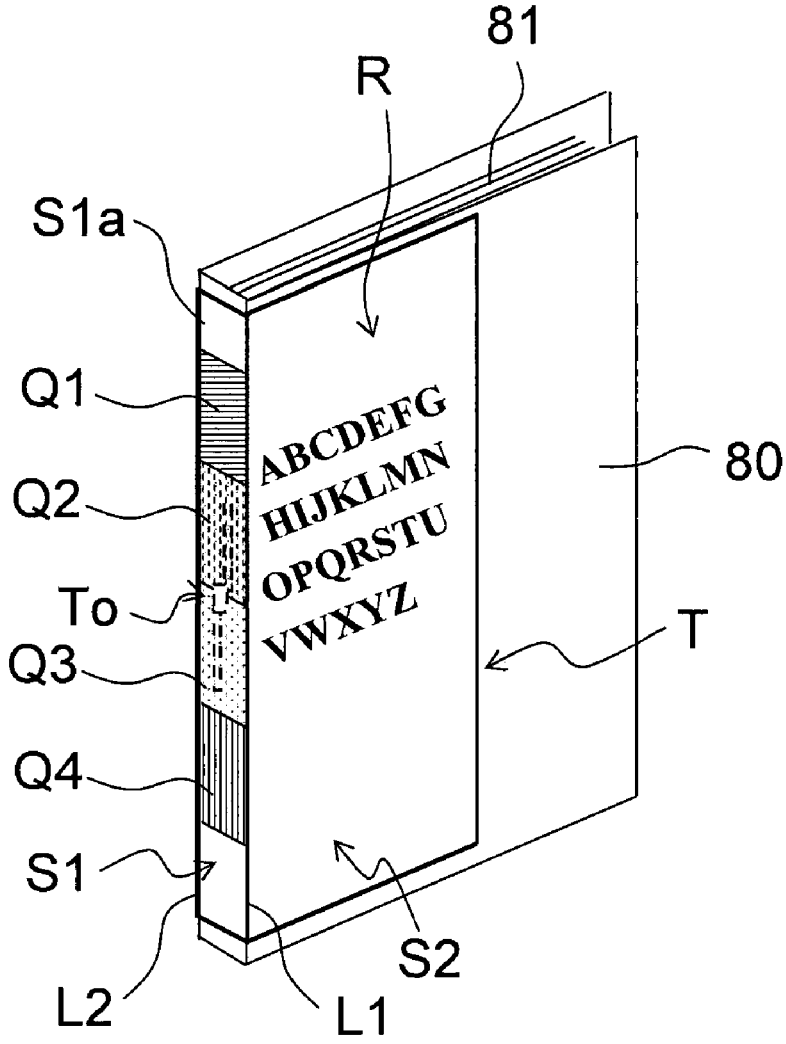
FIG. 8 is a perspective view illustrating an example in which the RFID label in FIGS. 7A to 7C is used for a file of a document.

As shown in FIG. 8, the RFID label T is attached to a surface of a file 80 that files a document 81 by the adhesive layer 3*b* (See FIGS. 7B and 7C) exposed by peeling off the separation sheet 3*a*. At this time, the RFID label T is mountain-folded along the folding lines L1 and L2. By means of this mountain folding, a mountain-folded shaped portion S1*a* including the RFID tag circuit element To is formed in the area S1 where the color printing Q is applied. The mountain-folded shaped portion S1*a* has a substantially planar shape corresponding to the spine of the file 80. The RFID label T is attached with the mountain-folded shaped portion S1*a* corresponding to the spine of the file 80. As a result, by containing the document 81 in a mode in which the color printing Q, that is, the color codes Q1 to Q4 exposed on the spine side of the file 80, the document 81 can be easily managed.

Figure 9:
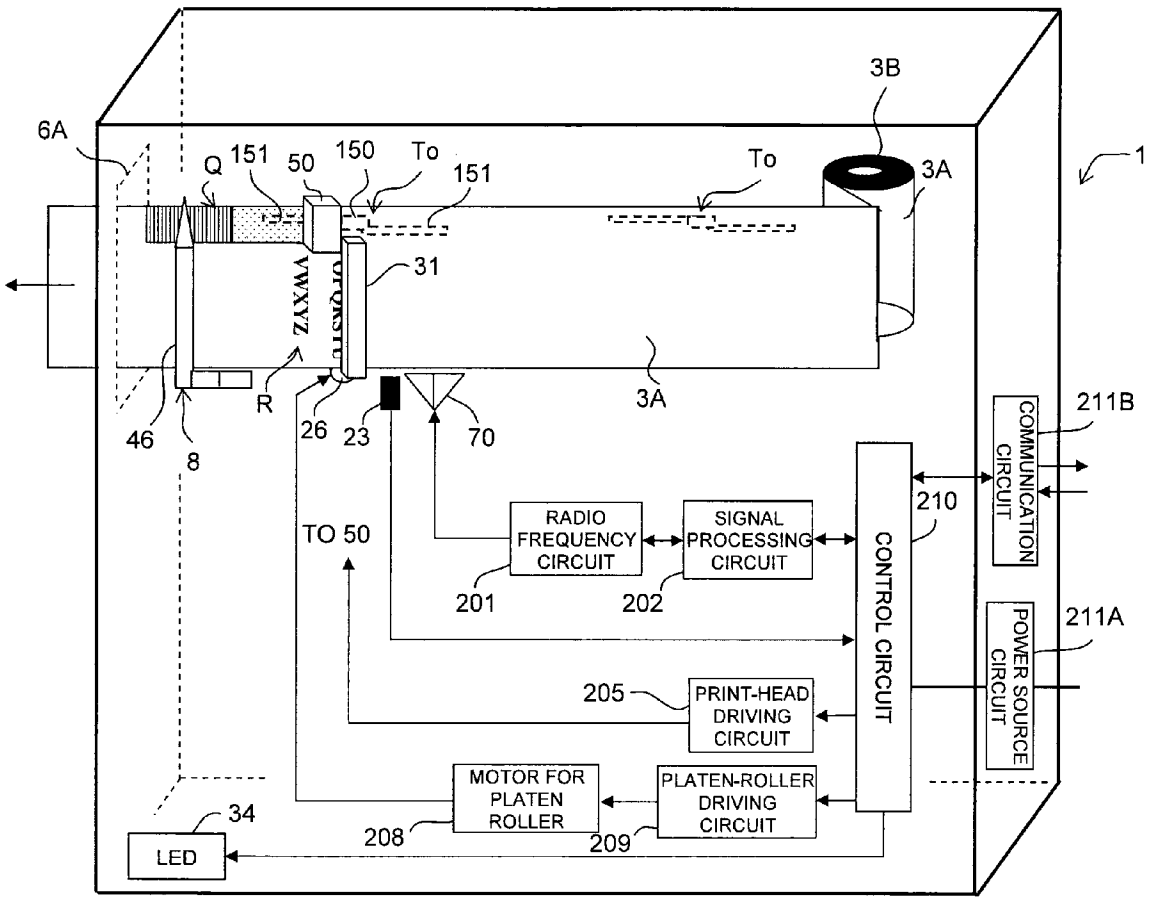
FIG. 9 is a conceptual diagram illustrating a control system of the apparatus for communicating with an RFID tag.

As shown in FIG. 9, on the tag tape 3A wound around the winding core 3B, a plurality of the RFID tag circuit elements To are aligned. As described above, after the tape head position mark TM disposed on the tag tape 3A is detected by the sensor 23, the monochrome printing R by the thermal head 31 and the color printing Q by the inkjet head 50 are applied to the tag tape 3A. During the printing, when the apparatus anntenna 70 is located at a position substantially opposite the RFID tag circuit element To disposed on the tag tape 3A, the feeding of the tag tape 3A is stopped. Then, transmission and reception of a signal is performed via radio communication between the apparatus antenna 70 and the RFID tag circuit element To and after the communication is completed, the remaining printing is resumed. The tag tape 3A on which the printing performed as above has been completed is cut off by the cutter unit 8 when the cutter button 7C of the cutter unit 8 is operated so that the RFID label T is produced.

Also, in FIG. 9, in the apparatus 1, a radio frequency circuit 201, a signal processing circuit 202, a print-head driving circuit 205, a platen-roller driving circuit 209, a control circuit 210, and an LED 34 are disposed. The print-head driving circuit 205 controls electricity to the thermal head 31 and electricity to the inkjet head 50. The platen-roller driving circuit 209 controls the motor 208 for platen roller that drives the platen roller 26. The LED 34 is turned on by a control signal from the control circuit 210.

The control circuit 210 is a so-called microcomputer including a CPU, which is a central processing unit, a ROM, and a RAM, for example. The control circuit 210 performs signal processing according to a program stored in the ROM in advance while using a temporary storage function of the RAM. The control circuit 210 controls an operation of the entire apparatus 1 through the radio frequency circuit 201, the signal processing circuit 202, the print-head driving circuit 205, the platen-roller driving circuit 209, and the sensor 23, for example. Also, the control circuit 210 is supplied with power by a power source circuit 211A and is connected to a communication line, for example, through a communication circuit 211B. The control circuit 210 is capable of exchanging information with a root server, another terminal, a general-purpose computer, and an information server, not shown, for example, connected to the communication line.

The signal processing circuit 202 inputs a signal read of the IC circuit part 150 of the RFID tag circuit element To through the radio frequency circuit 201 and reads information through predetermined processing.

The radio frequency circuit 201 makes an access to information of the IC circuit part 150 of the RFID tag circuit element To, that is, RFID tag information including a tag ID, through the apparatus antenna 70.

Figure 10:
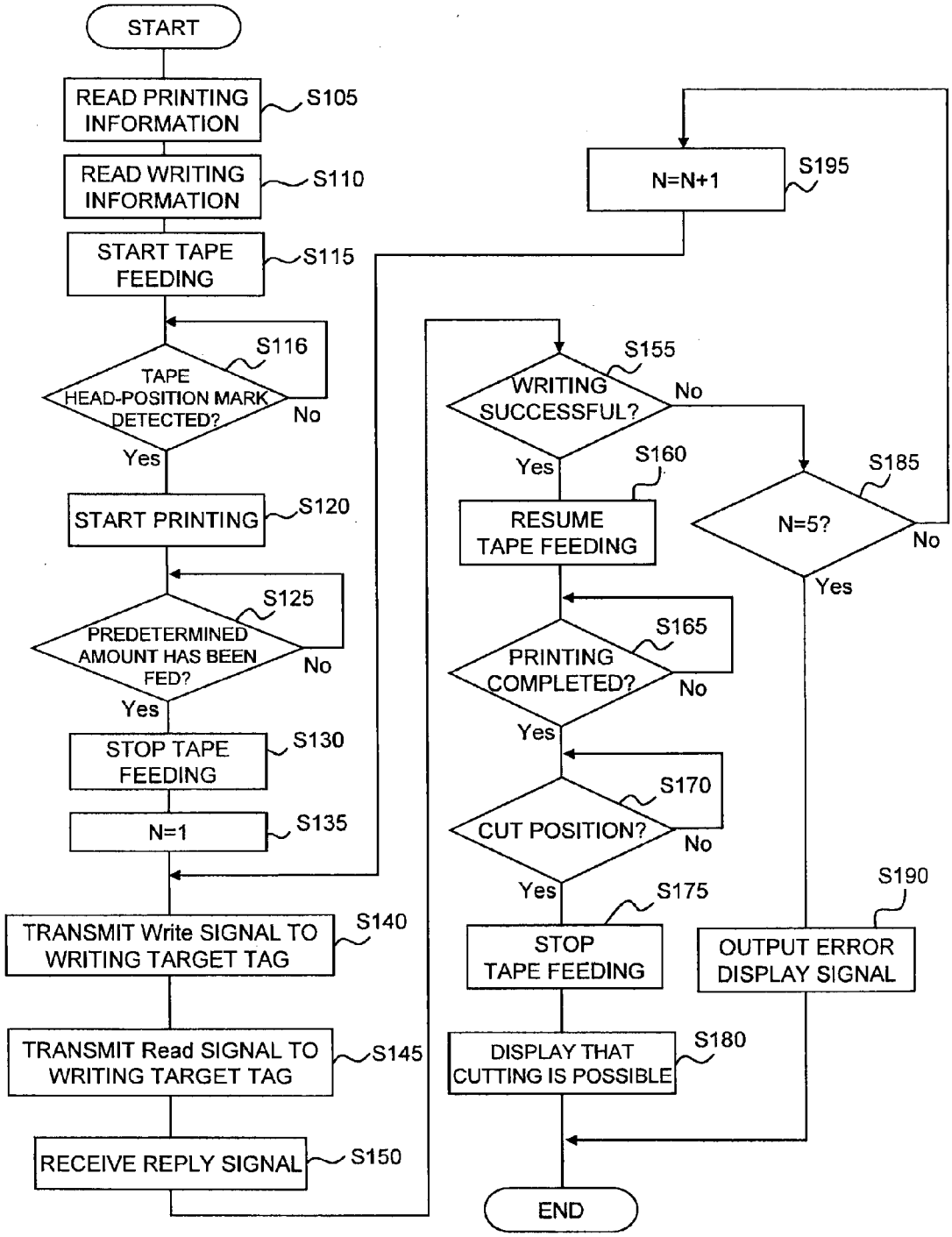
FIG. 10 is a flowchart illustrating a control procedure executed by a control circuit.

Control contents performed by the control circuit 210 will be described using FIG. 10. In FIG. 10, if a label production operation is made to the apparatus 1, this flow is started. This start is indicated at a "START" position in the illustration. This label production operation may be made by an operating device, not shown, such as a personal computer or a general-purpose computer connected to the apparatus 1. Alternatively, the label production operation may be performed by an operation button, for example, disposed in the apparatus 1.

First, at Step S105, the control circuit 210 reads single-color printing information and color-printing information on the basis of an input operation of the operating device. The single-color printing information is information of the monochrome printing R to be printed on the RFID label T by the thermal head 31. The color printing information is printing information of the color printing Q, that is, the color codes Q1 to Q4, to be printed on the RFID label T by the inkjet head 50. The single-color printing information and the color-printing information are read by the control circuit 210 through the communication line and the communication circuit 211B.

After that, at Step S110, the control circuit 210 reads writing information to be written in the IC circuit part 150 of the RFID tag circuit element To on the basis of an input operation of the operating device, for example, similarly to the above.

Then, the routine goes to Step S115, and the control circuit 210 outputs a control signal to the platen-roller driving circuit 209. As a result, the motor 208 for platen roller drives the platen roller 26 and feeding of the tag tape 3A is started. Then, at Step S116, the control circuit 210 determines if the sensor 23 has detected the tape head position mark TM or not. The determination at Step S116 is not satisfied till the tape head position mark TM is detected, and the routine stands by in a loop. If the tape head position mark TM is detected, the determination at Step S116 is satisfied, and the routine goes to Step S120.

At Step S120, the control circuit 210 outputs a control signal to the thermal head 31 and the inkjet head 50 through the print-head driving circuit 205. As a result, the thermal head 31 starts printing of the monochrome printing R of characters, symbols, and barcodes, for example, corresponding to the single-color printing information read at Step S105 on the area S2 of the thermal paper 3*c*. Also, the inkjet head 50 starts printing of the color codes Q1 to Q4 corresponding to the color-printing information read at Step S105 on the area S1 of the thermal paper 3*c*.

Then, at Step S125, the control circuit 210 determines if the tag tape 3A has been fed by a predetermined amount for which the RFID tag circuit element To has reached a position substantially opposite the apparatus antenna 70, in other words, substantially immediately above the apparatus antenna 70 or not during the tape feeding and the printing. This determination is made by detecting a feeding distance from a reference position by a predetermined known method. One of the known methods is counting the number of pulses outputted by the platen-roller driving circuit 209 that drives the motor 208 for platen roller, which is a stepping motor. Once the determination at Step S125 is satisfied, the routine goes to Step S130.

At Step S130, the control circuit 210 outputs a control signal to the platen-roller driving circuit 209. As a result, the driving of the platen roller 26 by the motor 208 for platen roller started at Step S115 is stopped, and the feeding of the tag tape 3A is stopped.

After that, at Step S135, the control circuit 210 makes initial setting of a variable N to 1. The variable N is a variable that counts the number of retries of communication, that is, the number of retry times if there is no response from the RFID tag circuit element To during the communication to the RFID tag circuit element To. In other words, the variable N is a variable that counts the number of access tries.

Then, the routine goes to Step S140, and the control circuit 210 outputs a "Write" command to write desired information in the memory part 155 of the RFID tag circuit element To to the signal processing circuit 202. As a result, the signal processing circuit 202 and the radio frequency circuit 201 generates a "Write" signal, that is, RFID tag information including a tag ID, for example. The generated "Write" signal is transmitted to the RFID tag circuit element To as an information writing target through the radio frequency circuit 201. As a result, the desired information is written in the memory part 155 of the RFID tag circuit element To.

After that, at Step S145, the control circuit 210 outputs a "Read" command to read data to the signal processing circuit 202. As a result, the signal processing circuit 202 and the radio frequency circuit 201 generates a "Read" signal. The generated "Read" signal is transmitted to the RFID tag circuit element To as an information writing target through the radio frequency circuit 201 and a reply is prompted.

After that, at Step S150, the control circuit 210 receives, that is, identifies a response signal transmitted from the RFID tag circuit element To as a writing target in accordance with the "Read" signal through the apparatus antenna 70 and takes it in through the radio frequency circuit 201 and the signal processing circuit 202.

Subsequently, at Step S155, the control circuit 210 checks information stored in the memory part 155 of the RFID tag circuit element To on the basis of the reply signal received in access processing at Step S140 to Step S150. That is, the control circuit 210 determines if the above-described transmitted predetermined information has been normally stored in the memory part 155 or not, that is, if writing has been successful or not. This determination is made by checking, for example, if the information included in the "Write" signal transmitted at Step S140 matches the information included in the reply signal received at Step S150 or not. Alternatively, this determination may be made by a known method using a CRC code, for example. The determination is satisfied if the information has been normally written in the memory part 155 of the RFID tag circuit element To, and the routine goes to Step S160.

At Step S160, the control circuit 210 outputs a control signal to the platen-roller driving circuit 209. As a result, the motor 208 for platen roller starts driving, and the rotation of the platen roller 26 is resumed. As a result, the feeding of the tag tape 3A is resumed.

After that, at Step S165, the control circuit 210 checks if the color printing Q on the area S1 and the monochrome printing R on the area S2 of the thermal paper 3*c* has been all completed or not at this time. After that, the routine goes to Step S170.

At Step S170, the control circuit 210 determines if the cutting position CL (See FIG. 5A) of the tag tape 3A has reached the position opposite the cutter unit 8. This determination is also made by the same method as in Step S125.

Then, the routine goes to Step S175, and upon satisfaction of the determination at Step S170, the control circuit 210 stops the feeding of the tag tape 3A by the platen roller 50 similarly to Step S130. After that, the routine goes to Step S180.

At Step S180, the control circuit 210 outputs a lighting control signal to the LED 34 and turns it on. By this lighting, it is displayed that the tag tape 3A can be cut by operating the cutter button 7C. Then, this flow is finished.

On the other hand, at Step S155, if the information is not normally written in the memory part 155 of the RFID tag circuit element To, the determination at Step S155 is not satisfied, and the routine goes to Step S185.

At Step S185, the control circuit 210 determines if the variable N is 5 or not. In the case of $N \leqq 4$, the determination is not satisfied, and the routine goes to Step S195. At Step S195, the control circuit 210 adds 1 to N. After that, the routine returns to Step S140, and the same procedure is repeated. As described above, even if the writing is not successful, the retry is made up to 5 times.

On the other hand, if the variable N is 5, the determination at Step S185 is satisfied, and the routine goes to Step S190. At Step S190, the control circuit 210 outputs an error display signal to a display device of the personal computer or the terminal, for example, through an input and output interface. As a result, a corresponding error display is made.

As described above, in the apparatus 1 of this embodiment, the inkjet head 50 applies color printing Q on the thermal paper 3*c* of the tag tape 3A that is being fed, and also, the thermal head 31 applies the monochrome printing R. Also, information transmission and reception is performed to the RFID tag circuit element To disposed on the tag tape 3A through the apparatus antenna 70. Then, using the tag tape 3A on which the color and monochrome printing and information transmission and reception have been completed, the RFID label T is produced.

At this time, the color codes Q1 to Q4 are printed as the color printing Q, and the RFID label T with color codes are produced. At this time, the inkjet head 50 prints the color codes Q1 to Q4 only on the area S1 of the tag tape 3A, while the thermal head 31 applies the monochrome printing R on the area S2. Since the printed area by the inkjet head 50 is limited, there is no need to scan the inkjet head 50 to a direction crossing the feeding direction at a right angle of the tag tape 3A or an orthogonal direction, for example, during the printing. As a result, the inkjet head 50 can be disposed fixedly, and printing time can be reduced. Also, the inkjet head 50 and the thermal head 31 divide the printing in the tape width direction. As a result, as compared with a case in which all the printing is made by disposing an inkjet head, which is long and big in the tape width direction, a cost can be reduced. As a result, while an increase in the cost is suppressed, the RFID label T with the color codes Q1 to Q4 can be efficiently produced in a reduced time. Particularly, by having a label format provided with an attachment function, a correlation with a target can be reliably maintained. Also, there is an effect that the RFID label can be attached to a curved shaped portion or a standing portion of the target.

Also, the color codes are widely used for document management in general and particularly disposed so as to surround and cover the front side of the spine of a document contained vertically in many cases. In this case, the color codes are usually disposed as a label in the mountain-folded shape so as to surround the spine. Then, particularly in this embodiment, the inkjet head 50 performs color printing on the area S1 containing the folding lines L1 and L2 for folding the RFID label T in use. As a result, by forming the mountain-folded shape on the folding lines L1 and L2, the RFID label T can be attached in an arrangement so as to cover the spine side. Moreover, at that time the file 80, that is, the document 81 can be contained in a mode in which the color codes Q1 to Q4 are exposed to the spine side. Therefore, file management can be performed easily.

Also, particularly in this embodiment, the thermal head 31 is arranged on the upstream side rather than the inkjet head 50 along the feeding direction of the tag tape 3A. As a result, the monochrome printing R by the thermal head 50 is performed prior to the color printing Q by the inkjet head 50. As a result, excess heat or pressure is not applied to ink of the color printing Q printed by the inkjet head 50. As a result, the color printing Q with excellent appearance can be performed.

Also, particularly in this embodiment, the RFID tag circuit element To is arranged in the area S1 of the tag tape on which the color printing Q is performed by the inkjet head 50. As a result, drop in durability of the RFID tag circuit element To caused by heat generated during performance of the monochrome printing R by the thermal head 31 can be prevented. Also, as described above, in the vicinity of the color codes Q1 to Q4 disposed on the spine in management of the file 80, the RFID tag circuit element To is located. That is, the RFID tag circuit element To is not embedded inside the file 80 but exposed to the spine side. As a result, when the file 80 is contained, communication to the RFID tag circuit element To can be performed favorably.

Also, particularly in this embodiment, the folding lines L1 and L2 are arranged on both sides in the width direction of the tag tape 3A with respect to the RFID tag circuit element To. That is, the folding lines do not pass through the position of the RFID tag circuit element To. As a result, when the RFID label T is folded on the folding lines L1 and L2, accidental damage on the RFID tag circuit element To can be prevented.

In the above-described embodiment, the apparatus antenna 70 is arranged on the upstream side rather than the thermal head 31 along the feeding direction of the tag tape 3A as described above. As a result, a printing mode corresponding to an information transmission and reception result through the apparatus antenna 70 can be considered. That is, such response that printing is not performed or printing that can identify failure is performed, for example, is possible in the case of communication failure. Specifically, printing of "NG" in the case of the communication failure can be considered. This printing can be made simply in the monochrome printing by the thermal head 31.

In the above-described embodiment, at Step S120 shown in FIG. 10, it may be so configured that the inkjet head 50 is controlled in a mode corresponding to the information transmission and reception contents through the apparatus antenna 70, that is, such that the color codes Q1 to Q4 are printed in colors or a design corresponding to the information transmission or reception mode. The control of the control circuit 210 functions as a printing control portion. In this case, it is only necessary that the color printing information at Step S105 is set in advance to a mode corresponding to the writing information inputted at Step S110 after that. Alternatively, the color printing information may be set such that Step S105 is omitted and the writing information in the IC circuit part 150 is read at Step S110 and then, a mode, that is, the color codes Q1 to Q4 of the colors and a design according to the read-in writing information, can be obtained. In this case, the following effects can be obtained.

That is, the information that can be usually written in the RFID tag circuit element To is larger than the information added to the color codes Q1 to Q4. Therefore, the control may be made such that the color codes Q1 to Q4 are printed in a mode corresponding to the information transmission and reception contents such as the writing information. In this case, by using a part of the information to be written in the RFID tag circuit element To in the color code, for example, the information on the RFID tag circuit element To side and the color code side can be associated with each other. As a result, convenience in management such as inventory taking of documents can be further improved. In this case, the following effects can be obtained.

On the contrary, at Step S140 shown in FIG. 10, it may be so controlled that information corresponding to a mode of the color codes Q1 to Q4 printed by the inkjet head 50 is written in the RFID tag circuit element To through the apparatus antenna 70. The control by the control circuit 210 functions as a writing control portion. In this case, it is only necessary that the writing information inputted at Step S110 is set in advance to contents corresponding to the color printing information inputted at Step S105. Alternatively, at Step S110, it may be set so as to be the writing information with the contents corresponding to the color printing information read at Step S105. In this case, first, the color codes Q1 to Q4 to be printed are determined and information corresponding to the color codes Q1 to Q4 is set to the writing information to be written in the RFID tag circuit element To.

That is, by writing the information corresponding to the color codes Q1 to Q4 in the RFID tag circuit element To, the information on the RFID tag circuit element To side and the color code side can be associated with each other. As a result, convenience in management such as inventory taking of documents can be further improved.

In the above-described embodiment, the tag tape 3A is provided with the thermal paper 3*c* made of a thermal material that produces color by heat and can form printing. That is, the monochrome printing R is performed by thermal transfer from the thermal head. However, the present invention is not limited to this method. That is, the tag tape 3A provided with a transfer layer constructed by a material to be transferred capable of printing by thermal transfer from an ink ribbon, that is, a so-called receptor layer instead of the thermal paper 3*c* may be used. In this case, the monochrome printing R is performed by thermal transfer of the thermal head through the ink ribbon. In these cases, too, the same effect can be obtained.

Also, in the above, the case in which the tag tape 3A for which reading or writing from or to the RFID tag circuit element To and printing have been finished is cut off by the cutter unit 8 so as to produce the RFID label T has been explained as an example, but not limited to that. That is, if a label mount separated in advance to a predetermined size corresponding to the label, that is, a so-called die-cut label is continuously arranged on a tape fed out of the roller, there is no need of cutting by the cutter unit 8. In this case, after the tape is ejected through a carry-out exit, the RFID label T may be produced by peeling the label mount provided with the accessed RFID tag circuit element To and corresponding printing off the tape. The present invention can also be applied to this type of tape.

Also, in the above, the operation of the cutter unit 8 is performed by operating the cutter button 7C, but the cutter unit 8 may be operated on the basis of a control command from the control portion 210.

Also, in the above, printing is applied on the print-receiving layer disposed on the tag tape 3A, that is, the thermal paper 3*c* or the transfer layer. In other words, this is a method in which tapes are not bonded together. However, not limited to that, that is, the present invention may be applied to a so-called laminate method in which the color printing Q and the monochrome printing R are performed on a print-receiving tape separate from a base tape provided with the RFID tag circuit element To and the base tape and the print-receiving tape after printing are bonded together.

Moreover, in the above, the case in which the tag tape 3A is made in the roll shape in the tape holder 3 and arranged in the tape holder container portion 4 and the tag tape is fed out is explained as an example, but not limited to that. For example, a lengthy flat paper or a strip-shaped tape or a sheet on which at least one RFID tag circuit element To is arranged may be used. In this case, the tape formed by being cut to an appropriate length after the tape wound around the roll is fed out may be used. In this case, the tapes and the sheets, for example, are stacked in a predetermined container portion and made into a cartridge. At that time, they may be stacked vertically and laminated in a tray-shaped container, for example, so as to be made into a cartridge. Such a cartridge may be attached to a cartridge holder on the side of the apparatus 1, transferred and fed from the container portion and printed and written so as to produce a RFID label.

Moreover, there can be a configuration in which a roll of a tape with RFID tags is detachably and directly attached to the side of the apparatus 1 or a configuration in which a lengthy flat sheet or a strip-shaped tape or sheet is transferred one by one by a predetermined feeder mechanism from outside the apparatus 1 so as to be supplied into the apparatus 1. Moreover, not limited to a structure such as a roll structure using the tape holder 3 that can be detachably attached to the side of the apparatus 1, the roll of a tape with RFID tags can be disposed on the side of the apparatus 1 as a so-called installed type or an integral type that cannot be removed. In this case, too, the same effect can be obtained.

Other than those described above, the methods of the above-described embodiment and the variations may be combined as appropriate for use.

Though not specifically exemplified, the present invention should be put into practice with various changes made in a range not departing from its gist.

What is claimed is:

1. An apparatus for communicating with a radio frequency identification (RFID) tag, comprising:

a feeding device that feeds a tag tape including an RFID tag circuit element having an IC circuit part storing information and tag antenna that performs information transmission and reception, said RFID circuit element being disposed on one side area along a width direction of said tag tape;

an inkjet head disposed fixedly so as not to be moved during an operation so that said inkjet head faces said one side area of said tag tape and color printing is applied to said one side area of said tag tape that is fed by said feeding device;

a thermal head that is disposed to face an other side area of said tag tape along the width direction other than said one side area of said tag tape that is fed by said feeding device to apply monochrome printing to said other side area; and an apparatus antenna that is disposed so as to face said one side area of said tag tape and performs information transmission and reception via radio communication with said RFID tag circuit element, wherein an arrangement position of said thermal head along the width direction and an arrangement position of said inkjet head along the width direction are overlapped partially with each other and printing by said inkjet head and said thermal head is performed so as to produce an RFID label.

2. The apparatus according to claim 1, wherein:

said inkjet head performs said color printing to said one side area including a folding line on which the RFID label is to be folded when said RFID label is used;

said thermal head performs said monochrome printing at least to said other side area not including said folding line; and said apparatus antenna performs said information transmission and reception with said RFID tag circuit element, the RFID tag circuit element arranged on the one side along the width direction or on the other side along the width direction of said tag tape from said folding line so that an area of said RFID tag circuit element does not include said folding line in a planar view.

3. The apparatus according to claim 2, wherein:

said inkjet head performs printing of a color identifier to an end portion in the one side of said tag tape so that said color identifier includes said folding line.

4. The apparatus according to claim 3, further comprising a printing control portion that controls said inkjet head so that said color identifier is printed in a mode corresponding to information transmission and reception contents by said apparatus antenna.

5. The apparatus according to claim 3, further comprising a writing control portion that writes information corresponding to a mode of said color identifier printed by said inkjet head in said RFID tag circuit element by said apparatus antenna.

6. The apparatus according to claim 1, wherein:

said thermal head is arranged on an upstream side rather than said inkjet head along a feeding direction of said tag tape by said feeding device; and said apparatus antenna is arranged on an upstream side rather than said thermal head along the feeding direction of said tag tape by said feeding device.

* * * * *